US011077350B2

(12) United States Patent
Antonov

(10) Patent No.: US 11,077,350 B2
(45) Date of Patent: Aug. 3, 2021

(54) TACKLING MACHINE

(71) Applicant: Stefan Raychev Antonov, Sofia (BG)

(72) Inventor: Stefan Raychev Antonov, Sofia (BG)

( * ) Notice: Subject to any disclaimer, the term of this patent is extended or adjusted under 35 U.S.C. 154(b) by 393 days.

(21) Appl. No.: 16/088,233

(22) PCT Filed: Apr. 4, 2017

(86) PCT No.: PCT/BG2017/000007
§ 371 (c)(1),
(2) Date: Sep. 25, 2018

(87) PCT Pub. No.: WO2017/173508
PCT Pub. Date: Oct. 12, 2017

(65) Prior Publication Data

US 2020/0406115 A1 Dec. 31, 2020

(30) Foreign Application Priority Data

Apr. 7, 2016 (BG) ..... 112267

(51) Int. Cl.

| | |
|---|---|
| ***A63B 69/34*** | (2006.01) |
| ***A63B 21/00*** | (2006.01) |
| ***A63B 21/005*** | (2006.01) |
| ***A63B 21/008*** | (2006.01) |
| ***A63B 71/02*** | (2006.01) |

(52) U.S. Cl.
CPC ..... *A63B 69/345* (2013.01); *A63B 21/0058* (2013.01); *A63B 21/0085* (2013.01); *A63B 21/4045* (2015.10); *A63B 71/023* (2013.01); *A63B 2071/025* (2013.01); *A63B 2209/00* (2013.01); *A63B 2210/50* (2013.01)

(58) Field of Classification Search
CPC ..... A63B 69/345; A63B 21/4045; A63B 21/0058; A63B 21/0085; A63B 71/023; A63B 2209/00; A63B 2210/50
USPC ..... 473/442
See application file for complete search history.

(56) References Cited

U.S. PATENT DOCUMENTS 2,255,711 A * 9/1941 Noor ..... A63B 69/345 73/379.04
2,532,880 A * 12/1950 Banbury ..... A63B 69/345 473/443

(Continued)

*Primary Examiner* — Eugene L Kim
*Assistant Examiner* — Rayshun K Peng
(74) *Attorney, Agent, or Firm* — Sutton Magidoff Barkume LLP

(57) ABSTRACT

It is designed to train athletes in rugby and/or American football, providing movement very close to the actual one and gives possibility to be mounted on scrum machine. Tackling machine comprises supporting frame structure (1) with shape of a parallelepiped and detachable connecting devices interconnect its elements. It is placed on ground (2). The longitudinal guide (6) has forked end and is mounted to the structure (1) through the forward end (61). The forked end (62) of the longitudinal guide goes outside the structure (1). At least one metal rod (8) whose upper end (81) protrudes above the parallelepiped, and carry at least one tensioner (9), connected to the forked end (62). The drive unit (10) is mounted to the fork-shaped longitudinal guide and has a working area arranged outside the structure (1). The tackling dummy (11) is attached to the carrier (12) by a detachable connecting device (13).

13 Claims, 6 Drawing Sheets

(56) References Cited

U.S. PATENT DOCUMENTS

| | | | | | |
|---|---|---|---|---|---|
| 2,749,121 | A * | 6/1956 | Myers | A63B 69/345 | 473/443 |
| 4,527,796 | A * | 7/1985 | Critelli | A63B 21/0602 | 473/442 |
| 2012/0309565 | A1 * | 12/2012 | Ponstein | A63B 71/023 | 473/443 |
| 2014/0357430 | A1 * | 12/2014 | Bognanno | A63B 71/023 | 473/442 |

* cited by examiner

TACKLING MACHINE

FIELD OF THE INVENTION

The tackling machine is designed to train athletes practicing the sports rugby and/or American football.

BACKGROUND OF THE INVENTION

From US 2012/0309565 A1, a tackling machine is known comprising a supporting frame structure consisting of load-bearing upper girder elements with I-shaped cross-section, connected together in the shape of a rectangle. The upper girder elements are connected to the columns, founded into the ground. Lengthwise and centrally of the rectangle, a longitudinal guide is mounted, to which are connected the left and right guides disposed in the rectangular shape delineated by the upper girder elements. At the intersection of the three guides, a switching device is located. To the longitudinal guide, a drive unit is mounted constituting a bearing carriage, driven by a spring element. On the bearing carriage, a tackling dummy is suspended by a carrier. The drive unit has an operating area between the columns of the supporting frame structure. The coach manages the switching device and performs carriage drive. The carriage is able to move straight along the longitudinal guide and/or at the choice of the coach, right or left.

The known tackling machine has drawbacks that create conditions for causing injuries to players because the training field is surrounded by columns and there is a possibility the athlete pursuing the tackling dummy to bump into any of them. The spring drive element prevents to achieve speed of the carriage movement and hence of the tackling dummy, corresponding to the modern technique of movement of rugby or American football players. Moreover, the training field, fixed by the foundation columns, significantly reduces the possibility of using the tackling machine at a new location.

SUMMARY OF THE INVENTION

The aim of the invention is to provide a tackling machine, the movable element of which resembles the motion of a fast rolling rugby or American football player, and thus to improve the performance of competitors in the defense phase counteracting faster and more maneuverable strikers, whereby the tackling machine to allow easy relocation, if needed, due to damage of the playground grass or for other reasons and to allow installation on a scrum machine.

This aim is achieved by a tackling machine comprising a supporting frame structure consisting of load-bearing upper girder elements connected with each other and with the columns. Centrally of the frame structure, lengthwise, a longitudinal guide is mounted to which a drive unit is installed with a suspended thereto carrier with a tackling dummy. According to the invention, the supporting frame structure has the shape of a parallelepiped, comprising all the elements forming its outline, namely upper girder elements, columns and lower girder elements and is placed on the ground. Moreover, the longitudinal guide is a fork-shaped tubular element and its mounting to the supporting frame structure is done through the forward end thereof by abutment bearing elements. The forked end of the fork-shaped tubular element goes outside the supporting frame structure which includes also fixed to it at least one metal rod whose upper end protrudes above the parallelepiped, and thereto is fixed at least one tensioner connected to the forked end of the fork-shaped tubular element. The drive unit is mounted to the fork-shaped tubular element and has a working area along the fork-shaped tubular element, arranged outside the support frame structure. The tackling dummy is attached to the carrier by a detachable connecting device.

In order to provide easy portability of the machine, the columns, the upper and lower girder elements of the support frame structure are interconnected by detachable connecting devices.

According to one embodiment, the tensioner is a chain.

According to another embodiment, the tensioner is a wire rope.

The drive unit is a carriage with wheels, which is disposed inside the fork-shaped tubular element, which has a slit along its entire length, wherein the carrier of the tackling dummy is situated.

Depending on the particular selected embodiment, the carriage may be driven by an electric motor or by compressed air.

In another embodiment of the drive unit, it is formed as a container for compressed air, on the one side of which there is a supply mouthpiece. Besides, the forked tubular element is formed by a pair of S-shaped tubes, positioned specularly to one another. The container for compressed air is belted by at least two hoops attached to each tube of the pair of tubes, and is also belted by at least one additional hoop to which the carrier of the tackling dummy is suspended.

Attachment of at least two hoops to each tube of the pair of tubes, as an embodiment, is achieved by climbing rolls.

Attachment of at least two hoops to each tube of the pair of tubes according to another embodiment is accomplished by rigging devices.

The detachable connecting device can be performed preferably as a flexible plate, passing through the openings of the double cap. The double cap includes, axially fixed at the upper end of the tackling dummy, a tubular connecting element having a diametrical opening, onto which a cap is affixed by a suspension element and two diametrically disposed openings corresponding to the diametrical opening of the tubular connecting element. Moreover, the flexible plate is inserted into the openings of the cap and the diametrical opening of the tubular connecting element.

Suitably, the carrier should have a fixed connection to the carriage and the cap of the double cap.

According to another embodiment, the detachable connecting device is of the type of flexible link between the suspension element, axially fixed at the upper end of the tackling dummy and the carrier.

The tackling dummy itself is filled by polystyrene foam and is extremely light.

The advantages of the invention are that it provides training approach that is very close to the actual movement of the players on the sports field, including opportunities are insured for training of "persecution" of the opposing player and implementation of a complete blockage at place while the competitor is safe. The possibility for causing injuries is avoided through the use of a lightweight tackling dummy, while the workout site is free from any props that might lead to unwanted injuries. Moreover, the tackling machine can be mounted on the so called scrum machine, which on one hand will maximize its mobility, and will act as a natural weight on the scrum machine itself.

DESCRIPTION OF THE EMBODIMENTS

Figure 1:
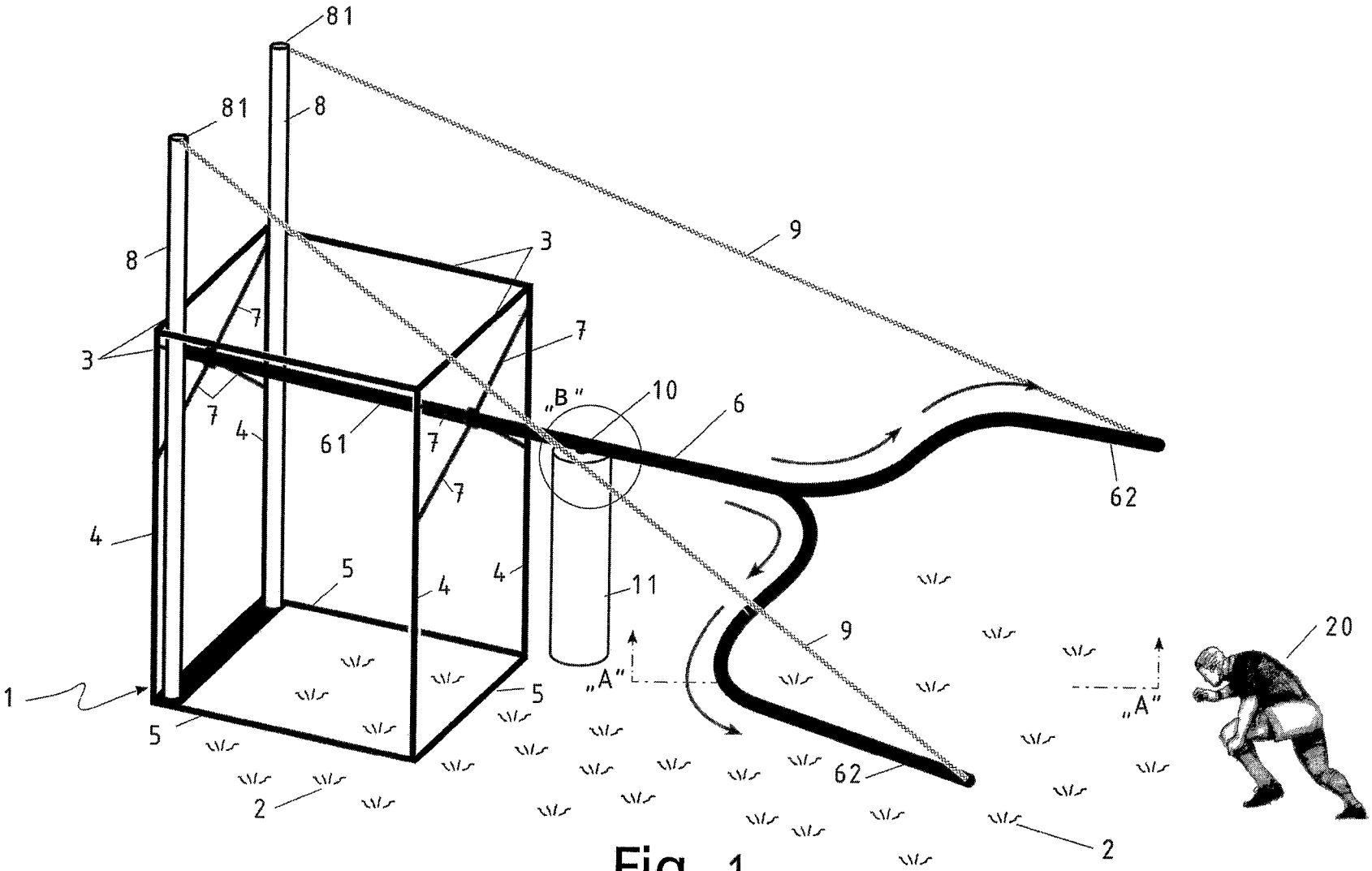
FIG. 1 is a general view of the tackling machine at the time of operation.
Figure 2:
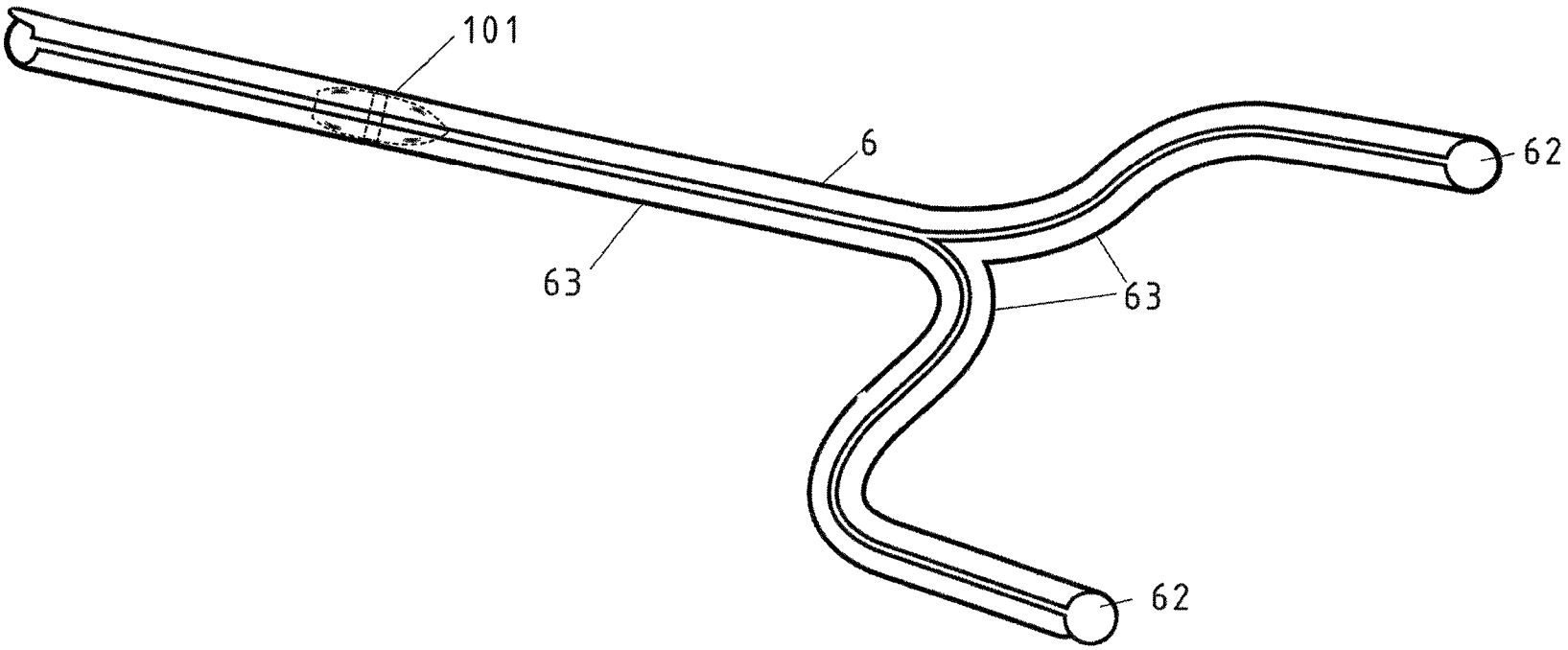
FIG. 2—partial view along line A-A of FIG. 1.
Figure 3:
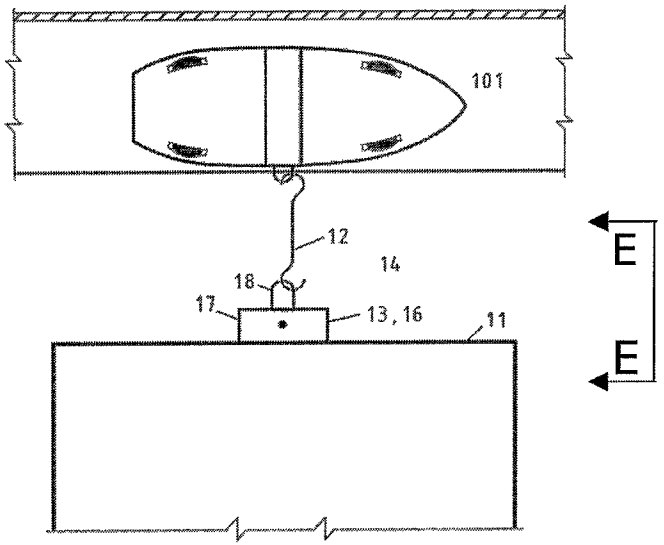
FIG. 3—detail B of FIG. 1.
Figure 4:
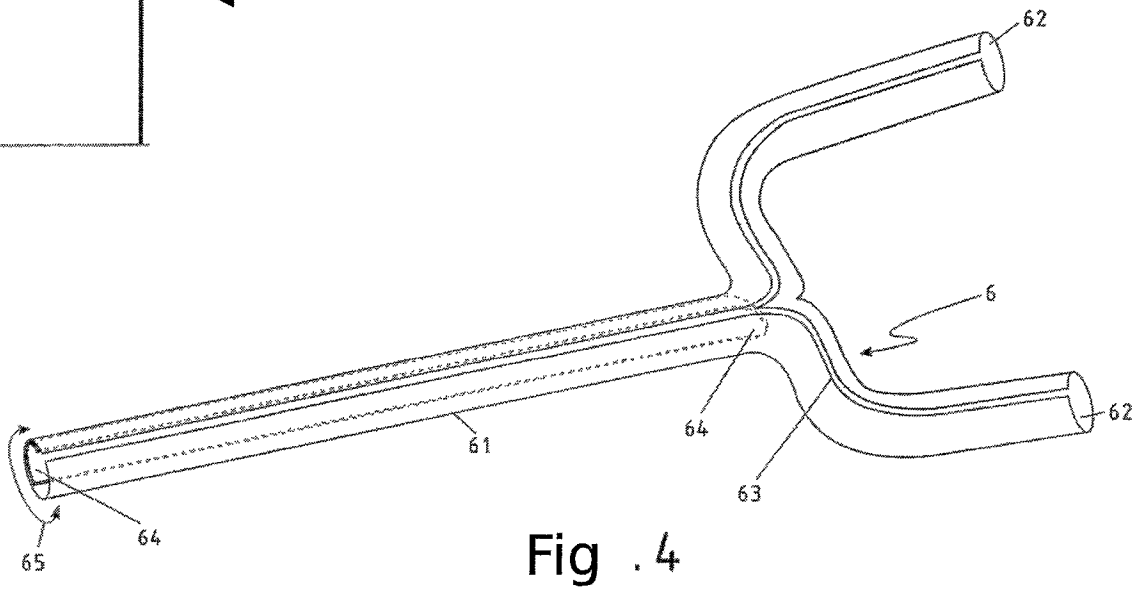
FIG. 4—partial view along line A-A of FIG. 1 with fitted guiding device.

The tackling machine comprises a supporting frame structure 1, which may be constructed of metal such as steel, aluminum, titanium and/or suitable plastic materials. The supporting frame structure 1 is the heaviest part and is a basis for the entire tackling machine, and it is placed on the ground 2. It has the shape of a parallelepiped which includes all the elements forming the outline, namely upper girder elements 3, columns 4 and lower girder elements 5. For all the elements forming the supporting frame structure 1, a cross-section may be selected according to the particular design solution, including a circular cross-section tubular or solid. Installation of the bearing frame structure 1 is provided by either permanent connecting means such as welding, or, preferably, connecting means permitting assembly and disassembly, such as a bolt connections, which will allow easy transfer to another exercise area, where needed. The detachable connecting means are of known type. When elements with tubular section are used, accordingly, the detachable connecting means are those known for connections between tubular elements. Lengthwise and centrally on the supporting frame structure 1, a longitudinal guide is mounted, which is a fork-shaped tubular element 6. The mounting of the fork-shaped tubular element 6 to the supporting frame structure 1 is done through the forward end thereof by abutment bearing elements 7. Forked end 62 of the fork-shaped tubular element 6 goes out of the supporting frame structure 1, and it defines a training field, located on the ground 2 between the supporting frame structure 1 and the forked end 62 of the fork-shaped tubular element 6. The supporting frame structure 1 includes a fixed to it at least one metal rod 8, whose upper end 81 projects above the parallelepiped. When one metal rod (not shown) is used, it would be good to be centrally located. To the upper end 81 of the metal rod 8, at least one tensioner 9 is connected made of chain or wire rope and connected to the forked end 62 of the fork-shaped tubular element 6. With the tensioner 9, balancing of the forces acting on the fork-shaped tubular element 6 is achieved.

To the fork-shaped tubular element 6, a drive unit 10 is mounted, to which a tackling dummy 11 is suspended. Alternatively, the drive unit 10 can be placed manually each time in the fork-shaped tubular element 6, at its end 61 which is located in the supporting frame structure 1. The drive unit 10 has a working area along the fork-shaped tubular element 6 located outside the supporting frame structure 1. Suspension of the tackling dummy 11 is effected by a carrier 12 to which the tackling dummy 11 is connected through a detachable connecting device 13. The carrier 12 is a rod or an elongated ring at both ends of which there are coupling means such as rings, hooks, carabiners, and the like, conventionally used in the art.

Figure 8:
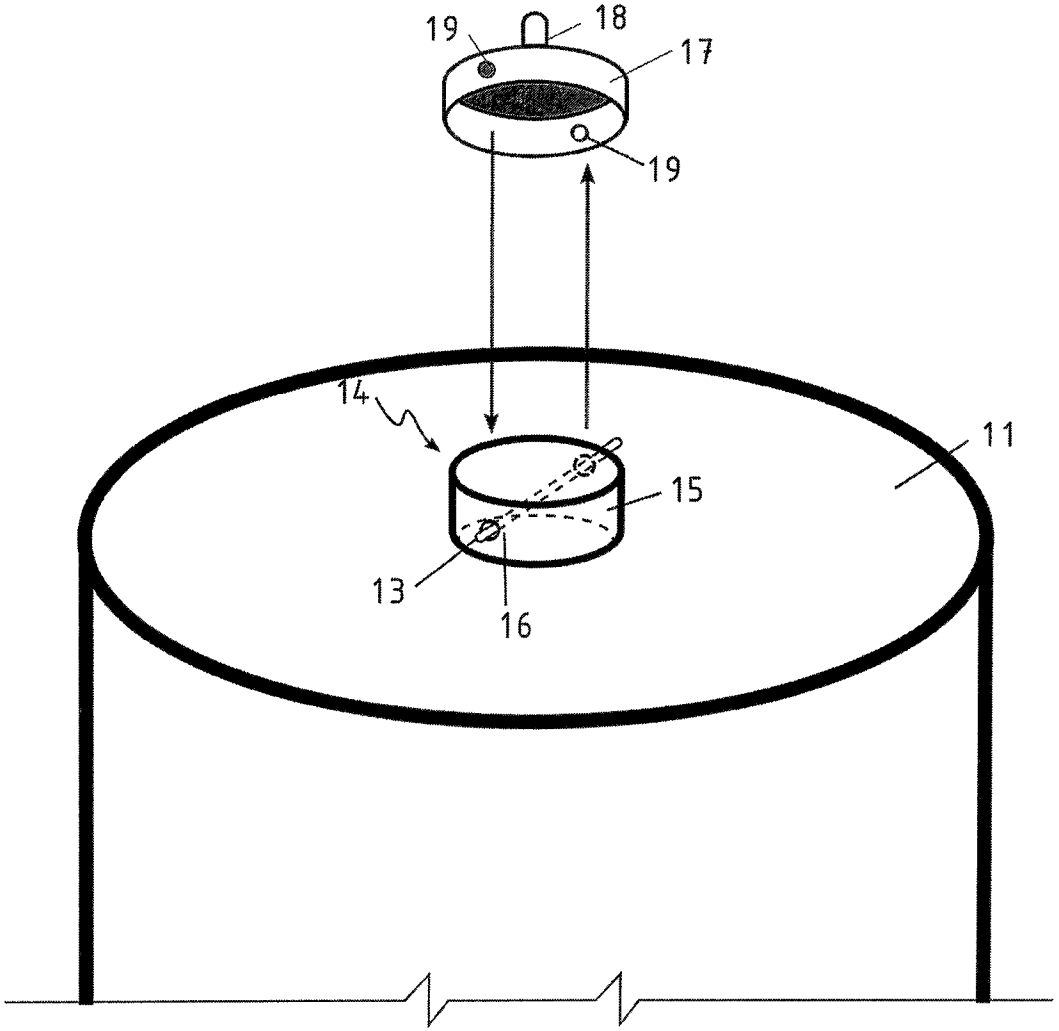
FIG. 8—view along E-E of FIG. 3 in disassembled condition.

The attached figures show various embodiments of the detachable connecting device 13, which provides joining of the tackling dummy 11 to the carrier 12. In one embodiment shown in FIG. 8, the detachable connecting device 13 takes the form of a flexible plate passing through the openings of a double cap 14 mounted on the tackling dummy 11. The double cap 14 includes axially fixed at the upper end of the tackling dummy 11 a tubular connecting element 15 with a diametrical opening 16. On the connecting element 15 a cap 17 is affixed with a suspension element 18, such as a ring or fixture. The cap 17 has two diametrically disposed openings 19 corresponding to the diametrical opening 16 of the tubular connecting element 15. In assembled condition, the flexible plate is inserted into the openings 19 of the cap 17 and the diametrical opening 16 of the tubular connecting element 15. It is recommended that the diameter of the cap 17 is greater by 6-9 mm than that of the tubular connecting element 15, which allows, when the player embraces the tackling dummy 11 and slackens on the dummy 11, the plate to bend under the weight and to detach the cap 17 from the tubular connecting element 15, i.e. to detach the tackling dummy 11 from the carrier 12.

According to one embodiment, the carrier 12 has a fixed connection with the carriage 101 and the cap 17, which assures its vertical position when moving at a high speed.

Figure 7:
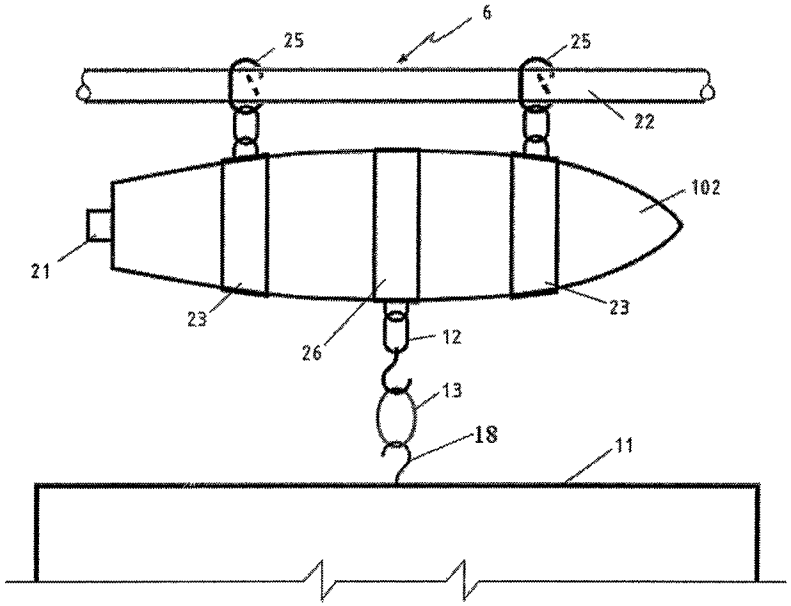
FIG. 7—view along D-D of FIG. 5, according to an embodiment of the suspension.
Figure 6:
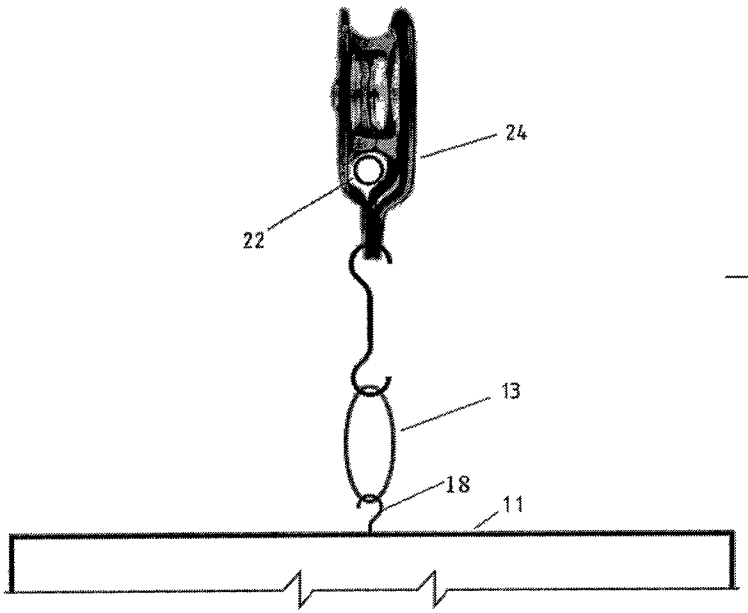
FIG. 6—section along C-C of FIG. 5

In another embodiment, shown in FIG. 6 and FIG. 7 the detachable connecting device 13 takes the form of a flexible link (textile, elastic band, etc.) between the suspension element 18, such as a ring fixed axially in the upper end of the tackling dummy 11 and the carrier 12.

In both embodiments shown, the detachable connecting device 13 allows detachment of the tackling dummy 11 from the carrier 12 when overloaded by the weight of the trainee player 20 when he "knocks down" a player of the opposing team. The use of a detachable connecting device 13 allows achieving maximum realism in the training, including by slacking the entire weight of the trainee player 20 on the tackling dummy 11.

The drive unit 10 may be a carriage 101 with wheels driven by an electric motor or by compressed air (not shown). The carriage 101 in this embodiment is disposed inside the fork-shaped tubular element 6. Then the fork-shaped tubular element 6 has a slit 63 along its entire length, in which the supported by the carriage 101 carrier 12 of the tackling dummy 11 is located. In the straight portion 61 of the fork-shaped tubular element 6, a guiding device 64 is mounted, controlled by the operator. It is a part of a thin-walled half-tube with a wing-tip connected at its beginning with a rotary drive unit, indicated by arrows 65. When rotating in one direction, the directing device 64 lets the moving carriage 101 pass along one branch of the fork-shaped tubular element 6 and when rotating in the opposite direction, respectively, the moving carriage 101 passes along the other branch of the fork-shaped tubular element 6. The rotary drive unit can be a lever system (not shown) located at the straight end of the fork-shaped tubular element 6. The rotary drive unit itself is subject to a particular design depending on the specific engineering solution, which does not limit the object of this invention.

Figure 5:
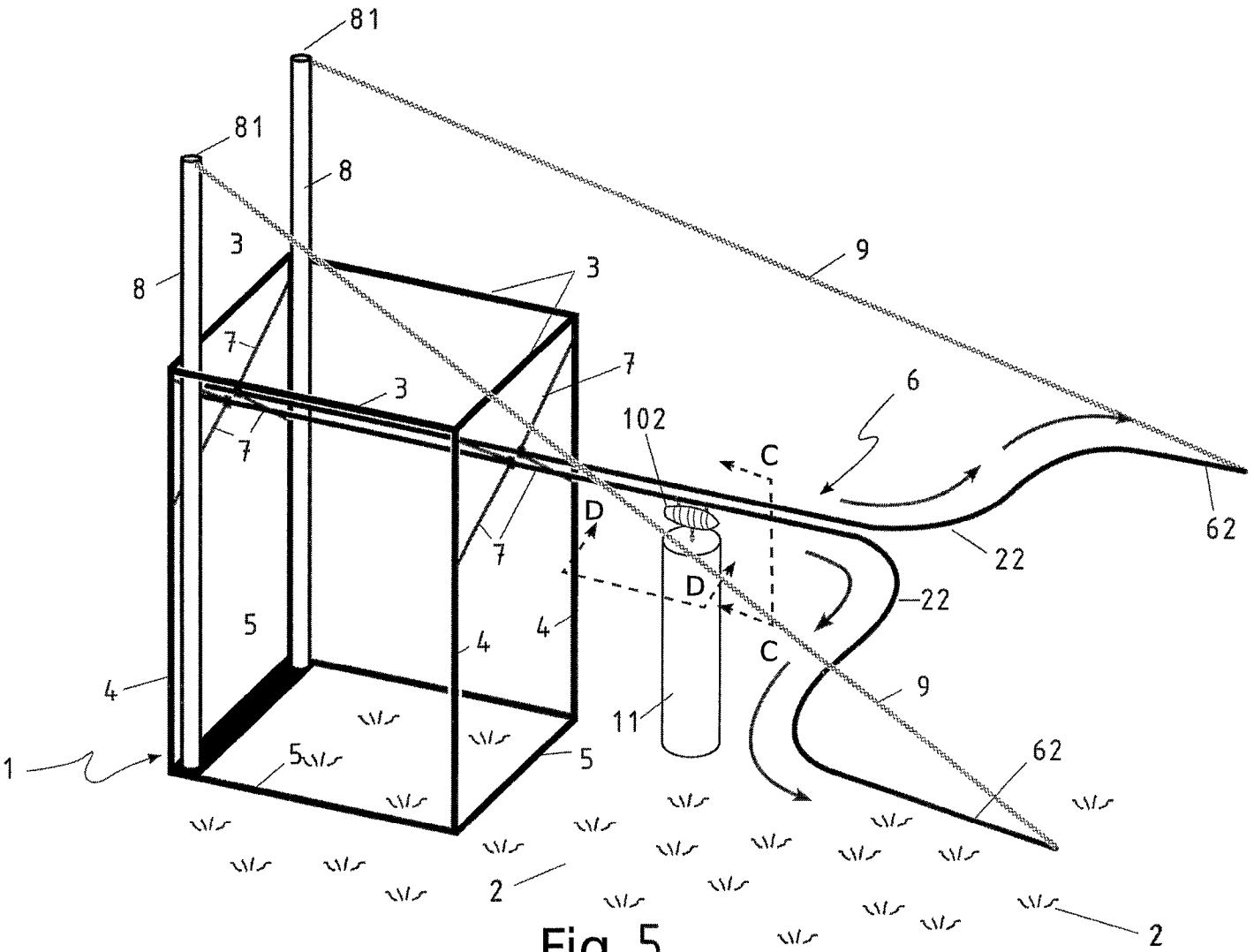
FIG. 5—general view of the tackling machine according to one embodiment.

According to another embodiment, shown in FIG. 5 and FIG. 7, drive unit 10 is a container for compressed air 102 on one side of which there is a supply mouthpiece 21. In this embodiment, the fork-shaped tubular element 6 is formed by a pair of S-shaped tubes 22, positioned specularly to one another. To the mouthpiece 21 in the base working position, a hose is mounted connected to a compressor. The container for compressed air 102 is belted by at least two hoops 23, attached to each tube of the pair of tubes 22 by, preferably, climbing rollers 24 (FIG. 6) or by rigging devices 25, such as rings connected to the carabiners as shown in FIG. 7. It is possible the carabiners to be located above or below the rings, these available options being equivalent and not departing from the scope of the invention. The container for compressed air 102 is belted with at least one additional hoop 26 to which the carrier 12 of the tackling dummy 11 is suspended.

The tackling dummy 11, itself is preferably made of polystyrene or textile and is filled with a lightweight material such as lightweight polyethylene foam, polystyrene or latex foam. Also, in one embodiment of the tackling dummy 11 it is made entirely of polystyrene foam. In general, the tackling dummy 11 weighs in the range of 0.5-2 kg, i.e. it is considerably light weighted compared to the known state of the art. This provides ease, flexibility and sufficient strength to its function. The tackling dummy 11 is cylindrical and its recommended height varies from 168 to 175 cm, this not limiting the choice of sizes.

The tackling machine is handled as follows:

In all shown embodiments, the operator, who normally is the coach, switches on the drive unit 10 which brings about the movement of the tackling dummy 11.

In the beginning of the workout, the carriage 101 or the container for compressed air 102 is located at the supporting frame structure 11. When the carriage 101 is used as a drive unit 10, the operator starts the engine by a remote control or by a switch installed at a convenient access location and it is driven on delineated by the fork-shaped tubular element 6 path. The direction of movement is shown by arrows in FIG. 1. The operator also actuates the guiding device 64 to select the path of the carriage 101 along the forked end 62 of the fork-shaped tubular element 6. That is, respectively, also the path of the tackling dummy 11.

When the tackling machine is made with a container for compressed air 102 as drive unit 10, the operator joins the hose from the compressor to the mouthpiece 21 of the container for compressed air 102, and supplies air thereto. When the container is filled with compressed air, the operator disconnects the hose from the mouthpiece 21 and releases the container for compressed air 102 to accomplish its purpose. It starts moving along the path set by the respective tube 22 of the pair of S-shaped tubes of the fork-shaped tubular element 6 from the supporting frame structure 1 towards the going outside end of the tube, forming the forked end 62.

At the movement, the tackling dummy 11 mimics the movement of a true athlete with the ball in his hands, training sports rugby or American football and moving into a phase of attack with speed close to reality. This movement requires maximum effort by the athlete-defenders and thus helps to improve their maneuverability and speed.

In the linear movement forward the player-striker inevitably collides with a defender, who aims to tackle him and thus break his way forward. To avoid this collision, the attacker can take surrounding movement to the left or to the right of the defender and then continue his way forward. This is exactly this maneuver that is re-created by the tackling machine, but there is a possibility of collision with a light tackling dummy 11. Thus the tackling machine helps to improve the fitness level of the trainee player 20 in the defensive phase of the game without leading to a real clash with a living opposition player, thereby reducing the risk of injuries.

The tackling machine is suitable for use in the training process and the competitor, improving his performance in defense, runs in its first phase against the carried by the drive unit 10 tackling dummy 11. After the drive unit 10, no matter of what kind, takes a turn along the forked end 62 of the fork-shaped tubular element 6, following the path set by this form, the athlete-defender turns in the direction of the tackling dummy 11 in order to block it. When the athlete-defender reaches it, he picks up the tackling dummy 11 and pulls it towards himself or towards the ground 2, at which point the detachable connecting device 13, whether flexible plate or link, deforms or tears and actually detaches the tackling dummy 11 from the carrier 12. Thus, it is possible to imitate a real blockage without damaging the integrity of the tackling machine 11. Only the integrity of the detachable connecting device 13 will be damaged, which is replaceable.

The invention claimed is:

1. A tackling machine comprising a supporting frame structure comprising a plurality of load-bearing upper girder elements connected with each other and with columns, and a longitudinal guide is mounted lengthwise centrally on the frame structure to which a drive unit is mounted with a tackling dummy suspended thereto on a carrier, wherein the supporting frame structure has the shape of a parallelepiped, comprising all the elements forming its outline, comprising upper girder elements, columns and lower girder elements, and it is placed on a ground surface, wherein the longitudinal guide is a fork-shaped tubular element and is mounted to the supporting frame structure by its the forward end abutting bearing elements and a forked end of the fork-shaped tubular element is located outside the supporting frame structure, which includes also fixed to it at least one metal rod comprising an upper end protruding above the parallelepiped, and at least one tensioner is fixed thereto, connected to the forked end of the fork-shaped tubular element, wherein the drive unit is mounted to the fork-shaped tubular element and has a working area along the fork-shaped tubular element, arranged outside the supporting frame structure, and the tackling dummy is attached to the carrier by a detachable connecting device, further wherein the drive unit comprises a carriage comprising wheels, which is disposed inside the fork-shaped tubular element which comprises a slit along its entire length, wherein the carrier of the tackling dummy is situated.

2. A tackling machine according to claim 1, characterized in that the columns, the upper and lower girder elements of the support frame structure are interconnected by detachable connecting devices.

3. A tackling machine according to claim 1, characterized in that the tensioner is made of a chain.

4. A tackling machine according to claim 1, characterized in that the tensioner is made of wire rope.

5. A tackling machine according to claim 1, characterized in that the carriage is driven by an electric motor.

6. A tackling machine according to claim 1, characterized in that the carriage is driven by compressed air.

7. A tackling machine according claim 1, characterized in that the drive unit is a container for compressed air on a side of which there is a supply mouthpiece, wherein the fork-shaped tubular element is formed by a pair of S-shaped tubes, positioned specularly to one another, and the container for compressed air is secured by at least two hoops attached to each tube of the pair of tubes, and is secured by at least one additional hoop, to which the carrier of the tackling dummy is suspended.

8. A tackling machine according to claim 7, characterized in that the attachment of the at least two hoops to each tube of the pair of tubes is accomplished by a climbing roller).

9. A tackling machine according to claim 7, characterized in that rigging devices are utilized for the attachment of the at least two hoops to each tube of the pair of tubes.

10. A tackling machine according to claim 1, characterized in that the detachable connecting device takes the form of a flexible plate, passing through openings of a double cap which includes axially fixed in the upper end of the tackling dummy a tubular connecting element with a diametrical opening on which a cap is arranged with a suspension element and with two diametrically opposite openings corresponding to the diametrical opening of the tubular connecting element and the flexible plate is placed in the openings of the cap and the diametrical opening of the tubular connecting element.

11. A tackling machine according to claim 1, characterized in that the carrier has a fixed connection to a carriage and a cap.

12. A tackling machine according to claim 1, characterized in that the detachable connecting device is of the type of flexible link between a suspension element axially fixed at the upper end of the tackling dummy and the carrier.

13. A tackling machine according to claim 1, characterized in that the tackling dummy is made of polystyrene foam.

* * * * *